US012655846B2

(12) United States Patent
Ferrarese et al.

(10) Patent No.: US 12,655,846 B2
(45) Date of Patent: Jun. 16, 2026

(54) SELF-PRIMING CENTRIFUGAL PUMP ASSEMBLY WITH MULTIFUNCTIONAL SEALING SYSTEM

(71) Applicant: Varisco S.r.l., Padua (IT)

(72) Inventors: Giulio Ferrarese, San Bonifacio (IT); Alessandro Gamba, Legnaro (IT); Semen Kuptcov, Padua (IT)

( * ) Notice: Subject to any disclaimer, the term of this patent is extended or adjusted under 35 U.S.C. 154(b) by 0 days.

(21) Appl. No.: 18/575,979

(22) PCT Filed: Jun. 27, 2022

(86) PCT No.: PCT/IB2022/055929
§ 371 (c)(1),
(2) Date: Jan. 2, 2024

(87) PCT Pub. No.: WO2023/281348
PCT Pub. Date: Jan. 12, 2023

(65) Prior Publication Data

US 2024/0309872 A1 Sep. 19, 2024

(30) Foreign Application Priority Data

Jul. 6, 2021 (IT) ..... 102021000017732

(51) Int. Cl.
*F04D 9/02* (2006.01)
*F04D 29/12* (2006.01)
*F04D 29/42* (2006.01)

(52) U.S. Cl.
CPC ..... *F04D 9/02* (2013.01); *F04D 29/126* (2013.01); *F04D 29/4293* (2013.01)

(58) Field of Classification Search
CPC ..... F04D 9/02; F04D 29/126; F16J 15/348
See application file for complete search history.

(56) References Cited

U.S. PATENT DOCUMENTS 2,769,390 A * 11/1956 Heimbuch ..... F04D 29/126 415/111
2,843,404 A * 7/1958 Janetz ..... F04D 29/126 277/394
3,081,095 A * 3/1963 Hamrick ..... F16J 15/38 277/306

(Continued)

FOREIGN PATENT DOCUMENTS

EP 2927544 10/2015

*Primary Examiner* — Courtney D Heinle
*Assistant Examiner* — Cameron A Corday
(74) *Attorney, Agent, or Firm* — Themis Law

(57) ABSTRACT

A self-priming centrifugal pump assembly with a multifunctional sealing system includes a pump having a housing with a downstream wet area and an upstream dry area equipped with bearings for supporting a drive shaft, and a volute pressure chamber in the downstream area to accommodate an impeller keyed to the shaft. The sealing system includes a tubular spacer mounted to the shaft proximate to the impeller, a mechanical seal mounted to the spacer, a first lip seal, and a locking ring for attaching the mechanical seal to the housing. The locking ring is removably fastened to the housing so as to be accessed through a suction port of the pump, so that the impeller, the mechanical seal, and the lip seal can be extracted and replaced or serviced without disassembling the pump and without accessing the bearings of the dry area.

12 Claims, 8 Drawing Sheets

(56) References Cited

U.S. PATENT DOCUMENTS

| | | | | |
|---|---|---|---|---|
| 4,815,747 | A * | 3/1989 | Wolford | F16J 15/348 277/306 |
| 5,409,350 | A * | 4/1995 | Mitchell | F04D 29/049 415/113 |
| 6,884,022 | B2 * | 4/2005 | Albright | F04D 29/126 415/113 |
| 2005/0134002 | A1 * | 6/2005 | Elliott | F16J 15/348 277/371 |
| 2008/0008577 | A1 * | 1/2008 | Cohen | F04D 29/126 415/121.1 |

* cited by examiner

SELF-PRIMING CENTRIFUGAL PUMP ASSEMBLY WITH MULTIFUNCTIONAL SEALING SYSTEM

FIELD OF THE INVENTION

The present invention generally finds application in the field of centrifugal operating machine and particularly relates to a self-priming centrifugal pump assembly with a multifunctional sealing system.

In a second aspect, the invention relates to a method of servicing a centrifugal pump assembly with a sealing system of the aforementioned type.

Background Art

Self-priming pumps are known to be a type of negative head pumps that require proper priming for proper operation.

Self-priming pumps have a suction lift to about 7-8 m. These pumps can prime by themselves and operate even without filling the suction line.

In addition, such line is not required to be equipped with a check valve that normally prevents the suction line from being emptied each time the pump is stopped.

The self-priming pumps of this invention are suitable for use in the field of building, for power generating sets, in municipalities, urban wastewater, mining, bilge drainage, flood drainage, mines, sewerage, fire-fighting.

One problem with these pumps is that they are forced to operate for some time without liquid, for example during the priming stage.

Here, the seals between the stationary and rotating parts are likely to "run dry" and are prone to breaking or burning.

Attempts have been made to obviate this drawback by providing either a quench system to flush the sealing ring faces with a suitable coolant, typically oil, for cooling these faces, or a heating agent, e.g. steam, to heat the same faces in case of cartridges with waxes or polymers that remain liquid only when kept at a certain temperature.

The seal usually comprises a lip seal that interacts with a tubular spacer mounted to the shaft to resist wear, and a mechanical seal to isolate the wet part of the pump from the dry part near the motor bracket.

At present, the maintenance of mechanical seals is very complex and requires the action of specially skilled operator.

In addition, the lip seal adjacent to the quench circuit cannot be usually replaced on site.

Therefore, the need is felt for easier servicing of self-priming pumps in any working and logistical condition by non-specially skilled personnel.

A further drawback of this type of pump is that under certain operating conditions a very high vacuum can be established in the pump, which may lead to suction and thus removal of the mechanical seal from the seat of the stationary part, with disastrous consequences for pump operation.

Another drawback of these known self-priming pumps is the possible failure of or leakage from a seal located at the edge of the wet area of the pump. Here, leakage may cause fluid infiltration into the dry area and affect critical components, such as a shaft bearing immediately downstream of the seal, with serious risk of damage to the bearing and pump blockage.

US 2010/090412 discloses a sealing system comprising a cartridge with a support spacer element designed to fit onto the shaft and having a ring for holding a spring, a centering washer, a bellows seal, a mechanical seal with a stationary ring and a moving ring.

US 2016/108926 discloses a sealing system with a cartridge seal for a centrifugal pump that uses a compressed gas for cartridge sealing.

U.S. Pat. No. 5,409,350 discloses a sealing system with a cartridge for a centrifugal pump, which comprises a bearing and a mechanical seal with a stationary part and a rotating part facing each other.

The stationary part is housed in a housing and the moving part is housed in a housing with holes for circulation of a coolant. The sealing system does not include a spacer fitting onto the drive shaft or a retaining ring to hold the cartridge in place.

Technical Problem

In view of the prior art, the invention has the object to simplify servicing of the sealing system in any operating condition by avoiding the need to fully disassemble the pump, and also to prevent damage to the pump due to removal of part of the mechanical seal as a result of the vacuum effect, as well as deterioration of the bearings in the dry area of the pump caused by breakage of or leakage from the seal between the wet area and the dry area of the pump.

DISCLOSURE OF THE INVENTION

The object of the present invention is to solve the aforementioned technical problems and obviate the above drawbacks by providing a self-priming centrifugal pump assembly with a multifunctional sealing system, that is highly efficient and relatively cost-effective.

A particular object of the present invention is to provide an assembly of the aforementioned type that facilitates removal and replacement of seals even when the pump is on site.

A particular object of the present invention is to provide an assembly of the aforementioned type that prevents dry running of the wiping-contact surfaces of the mechanical seal.

A particular object of the present invention is to provide an assembly that can simply servicing and allow it to be carried out even by non-specially skilled personnel.

A further object is to provide an assembly that avoids the risk of removal of the stationary part of the mechanical seal as a result of the high vacuum created in the volute of the pump.

Yet another object is to provide an assembly that prevents the ingress of liquid into the dry part of the pump, which would cause damage to the bearings as a result of failure or leakage from a broken seal.

These and other objects, as more clearly explained hereafter, are fulfilled by a self-priming centrifugal pump assembly with a multifunctional sealing system as defined in claim 1.

Conveniently, the pump comprises a housing having a downstream wet area contacted by the working fluid and an upstream dry area not contacted by the working fluid and equipped with bearings for a drive shaft. The pump also comprises a volute pressure chamber in the downstream area, which is designed to accommodate an impeller intended to be keyed to the drive shaft.

The multifunctional sealing system comprises a tubular spacer mounted to the shaft and adapted to be attached to the shaft proximate the impeller, a mechanical seal mounted to the spacer, at least one first lip seal, and a locking ring for attaching the mechanical seal to the pump housing.

Advantageously, the pressure chamber has a suction port whose inside diameter is larger than that of the impeller and a front closing flange whose inside diameter is smaller than that of the impeller. The locking ring is designed to be secured to the pump housing by removable fastening means, that can be accessed through the suction port of the pump after removal of its front closing flange to allow removal of the impeller, the mechanical seal and the lip seal and replacement or servicing without disassembling the pump and without accessing the bearings in the dry area.

This arrangement will greatly simplify servicing of the mechanical seal and replacement of the seals, which may occur without completely disassembling the pump. Of course, simplified servicing will also reduce pump operation times and costs.

In addition, the bearings are protected in case of leakage.

In a further aspect, the invention provides a method of servicing a self-priming centrifugal pump assembly with a multifunctional sealing system as defined hereinafter.

The method comprises at least the steps of providing a suction port in the pressure chamber, whose inside diameter is larger than that of the impeller and a front closing flange whose inside diameter is smaller than that of the impeller, removing a connecting joint from the suction line, removing the front closing flange, axially pulling off the impeller from the pressure chamber, removing fastening means, removing the locking ring from the compartment of the intermediate housing in combination with the cartridge assembly with the lip seal joined thereto or removing the locking ring from the compartment of the intermediate housing in combination with the half-cartridge assembly and removing the lip seal, replacing the lip seal and possibly the mechanical seal or some of its components, repositioning the locking ring with the cartridge or half-cartridge system, mounting the impeller back to the shaft and mounting the connecting joint back to the suction line.

Conveniently, removal of the impeller from the shaft and the locking ring from its seat of the intermediate housing, as well as repositioning thereof, are carried out through the suction port after disassembly and removal of the front closing flange without completely disassembling the pump.

In addition, the cartridge or half-cartridge is removed without removing the bearings from the dry area of the pump housing.

With this method even partial disassembly of the pump and its accessories may be avoided, which greatly simplifies servicing and replacement of gaskets and/or mechanical seals.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a multifunctional sealing system of the invention, which is described as a non-limiting example with the help of the annexed drawings, in which.

DETAILED DESCRIPTION OF A PREFERRED EXEMPLARY EMBODIMENT

Figure 1:
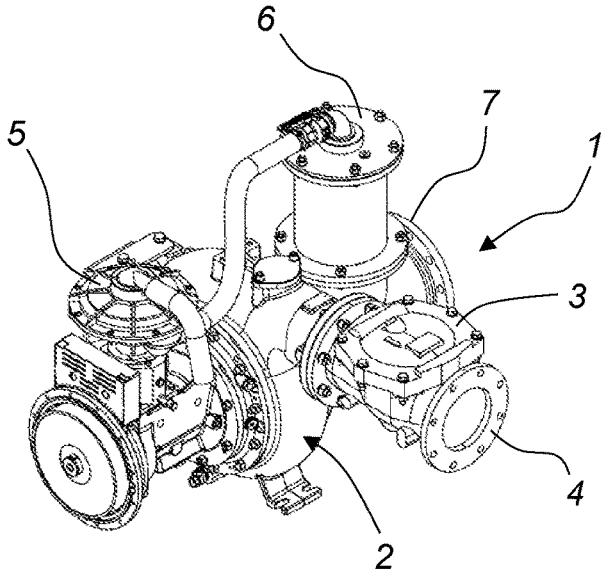
FIG. 1 is an axonometric view from the delivery port side of a self-priming centrifugal pump with the sealing system of the invention mounted thereon.
Figure 2:
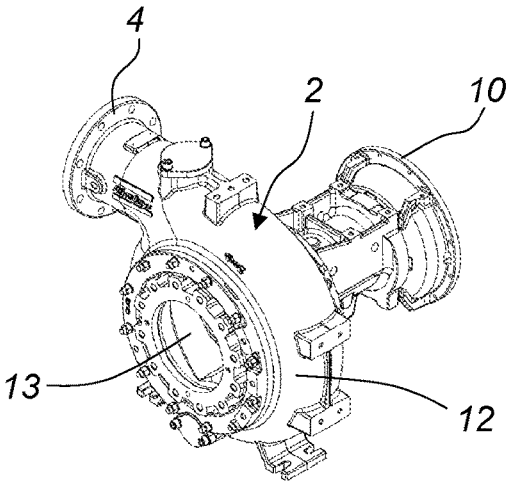
FIG. 2 is an axonometric view of the pump housing of FIG. 1 without the motor as viewed from the suction port side.
Figure 3:
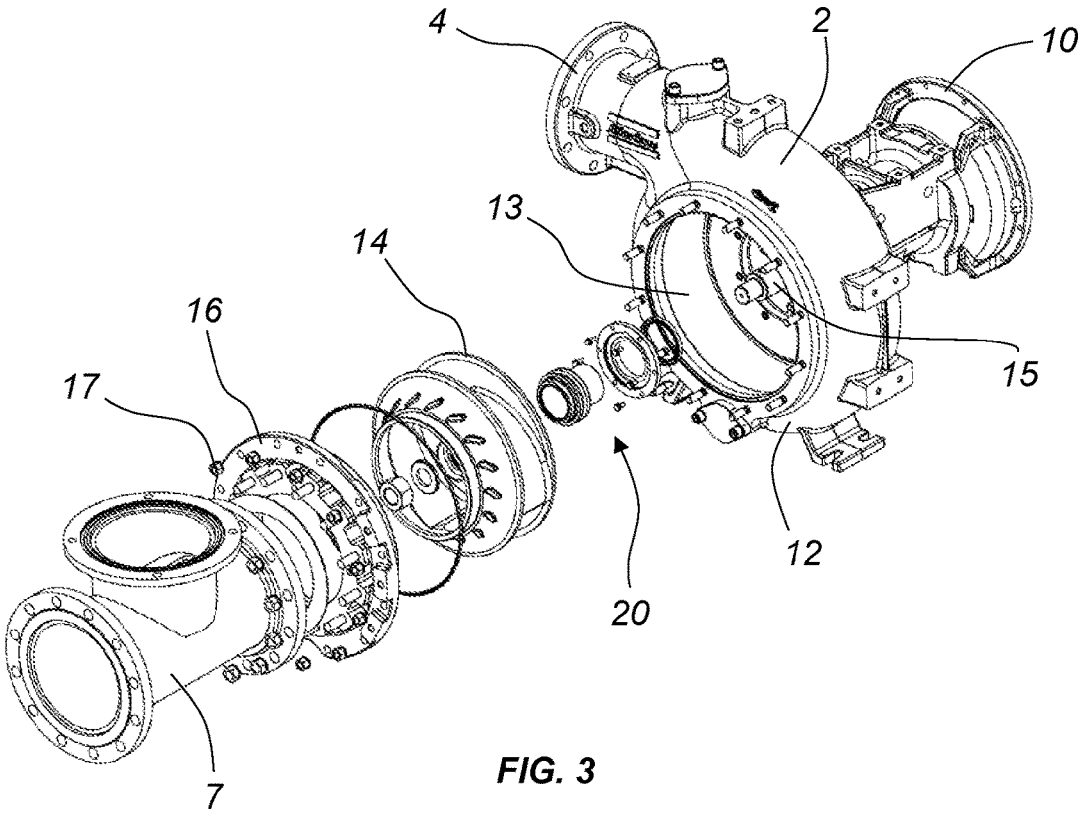
FIG. 3 is an axonometric view of the pump housing of FIG. 2 with certain details removed to show a step of the method of servicing the sealing system of the invention.

Referring to the aforementioned figures, there is shown a self-priming centrifugal pump assembly 1 with a multifunctional sealing system 20.

The pump 1 comprises a housing 2, a non-return valve 3 mounted to the delivery port 4, a vacuum pump 5 for priming the pump, an air/liquid separator 6 connected to the vacuum pump 5 and connected to a stub 7 at the suction port.

More in detail, the pump housing 2 comprises a downstream area 8, conventionally known as "wet", contacted by the working fluid, and an upstream area 9, conventionally known as "dry".

The upstream area 9 has an essentially bell-shaped end portion 10, that must not be accessed by the working fluid for motor safety.

The two areas 8, 9 are connected to each other by an essentially annular intermediate housing 11 which has the purpose to support the motor, not shown.

The dry area 9 has bearings 10', 10" for supporting a drive shaft 15.

The pump housing 2 consists of a conventional pressure chamber 12, located in the downstream area 8, usually shaped as a volute of predetermined geometry, which has a suction port 13 and accommodates an impeller 14 with radial or axial-radial blades, also of predetermined geometry, which are designed to convert kinetic energy into pressure energy.

The impeller 14 is removably keyed to the shaft 15 having a longitudinal axis L, by means of removable connection components of known type, such as a key and a nut tightened to the threaded end of the shaft 15.

In one embodiment, the suction port 13 is equipped with a front closing flange 16 which is secured to the pressure chamber 12 by a ring of fastening bolts 17.

Advantageously, the pressure chamber 12 has a suction port 13 whose inside diameter is larger than that of the impeller 14 and the closing flange 16 has an inside diameter that is smaller than that of the impeller 14.

Figure 4:
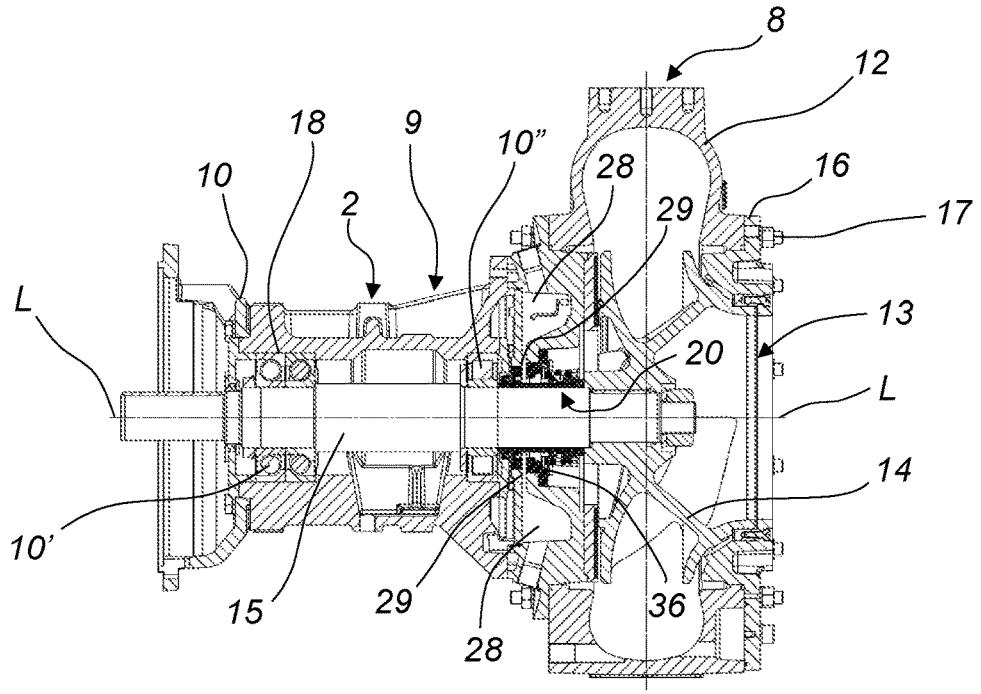
FIG. 4 is a broken-away view of the pump housing of FIG. 1 without the motor and without accessories, as taken along an axial vertical plane in a first embodiment with a cartridge sealing assembly.
Figure 5:
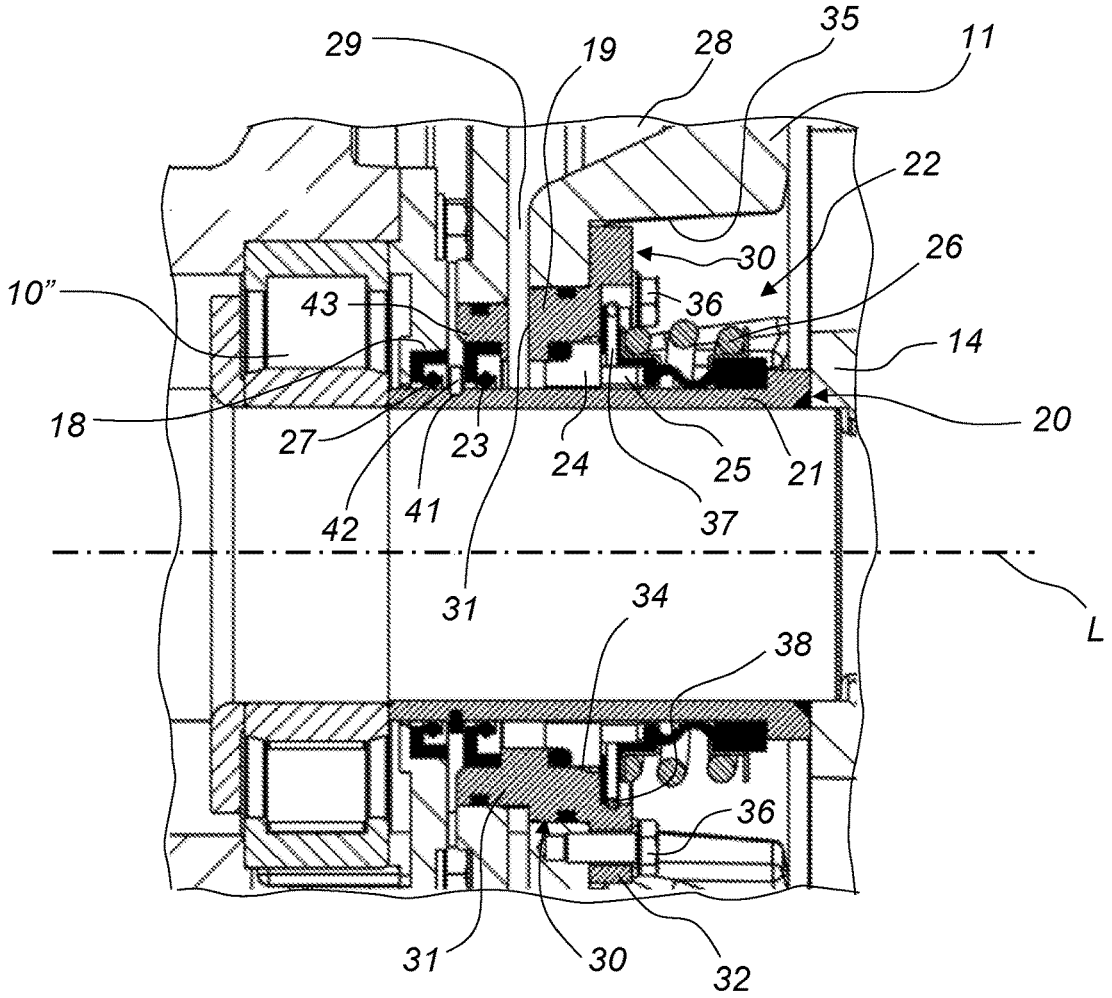
FIG. 5 is an enlarged view of the section of FIG. 4, showing the sealing system of the invention in greater detail.
Figure 13:
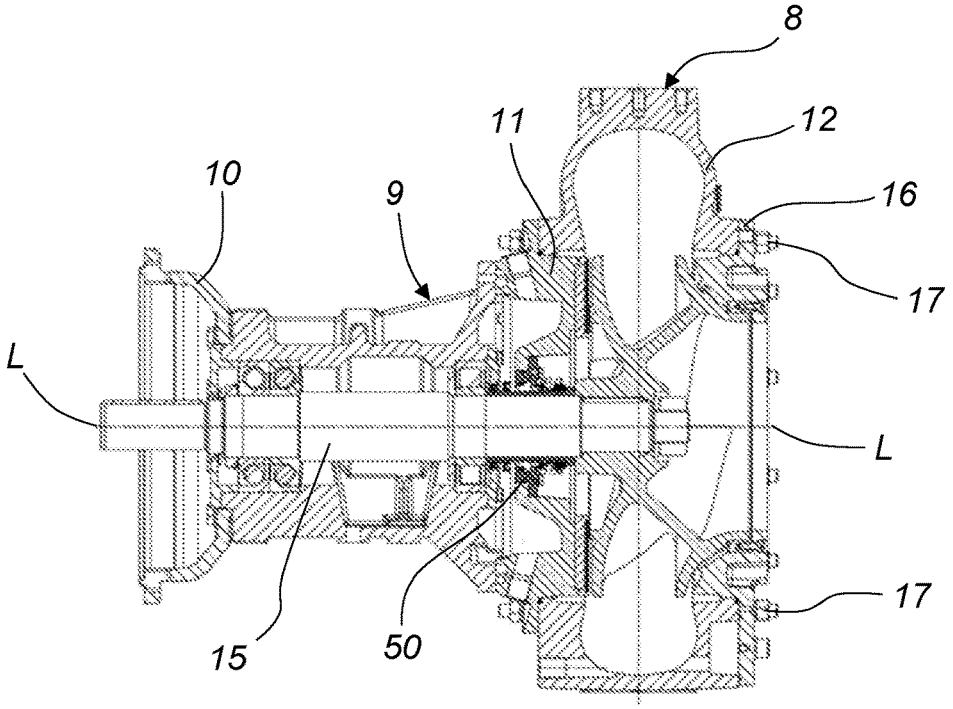
FIG. 13 is a broken-away lateral view of the pump of FIG. 1 without the motor and without accessories, as taken along an axial vertical plane in a second embodiment with a half-cartridge sealing assembly.
Figure 14:
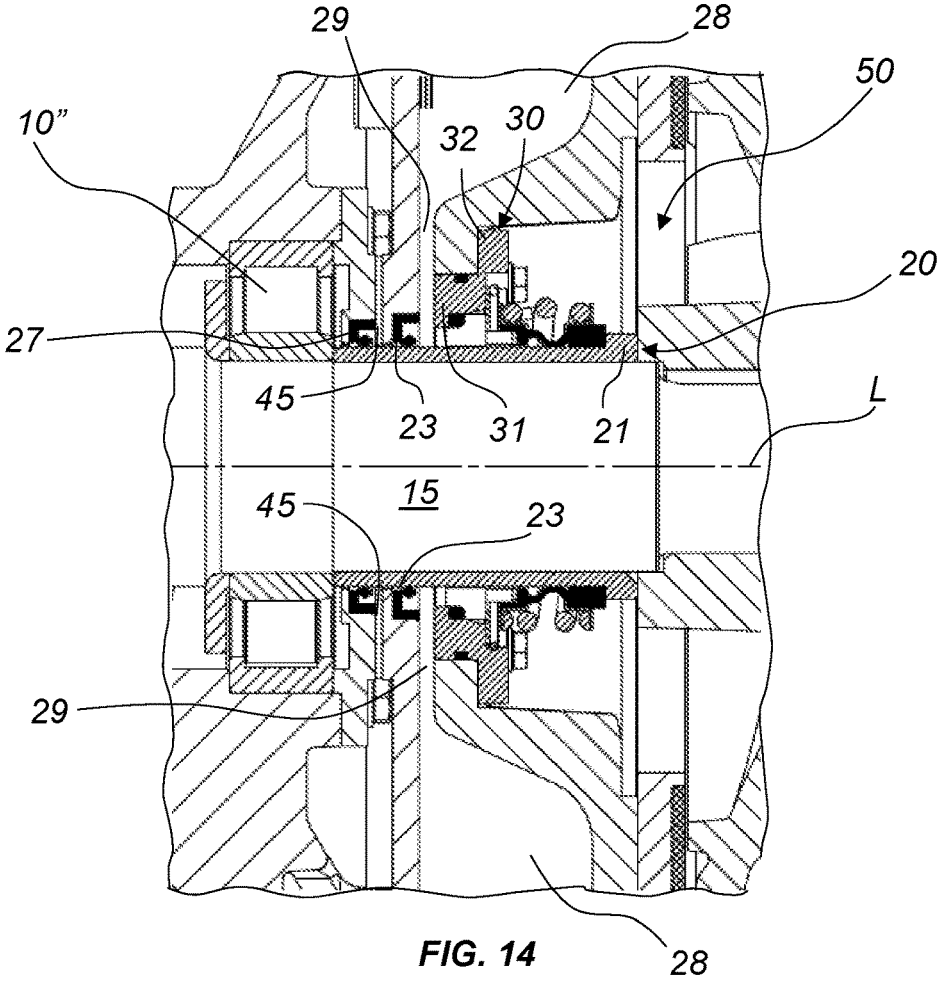
FIG. 14 is an enlarged view of the section of FIG. 13, showing the sealing system of the invention in greater detail.

The invention provides a multifunctional sealing system, generally designated by numeral 20 and shown in a sectional view, according to a first embodiment in FIGS. 4 and 5 and to a second embodiment in FIGS. 13 and 14. The multifunctional sealing system 20 has the purpose to separate the two areas 8, 9 for safety reasons and to allow proper operation of the pump 1.

The sealing system 20 comprises an essentially tubular spacer 21, which is adapted to be mounted and attached to the drive shaft 15 proximate the impeller 14.

A so-called mechanical seal 22 is mounted to the periphery of the spacer 21, and at least one first lip seal 23 with an inner peripheral lip or edge is in wiping contact with the outer cylindrical surface of the spacer 21, to seal the wet area 8 from the dry area 9 of the pump 1.

Figure 22:
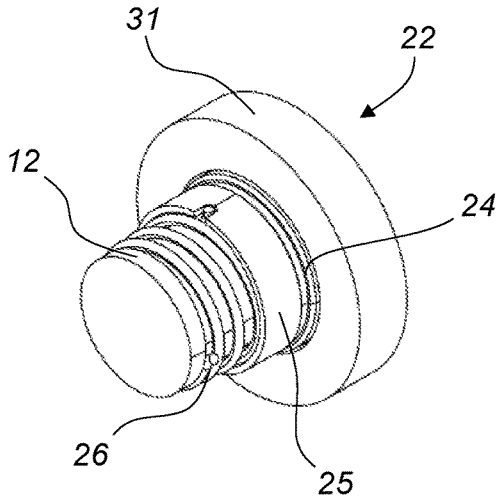
FIG. 22 is an axonometric view of a detail of the sealing system of the invention.
Figure 23:
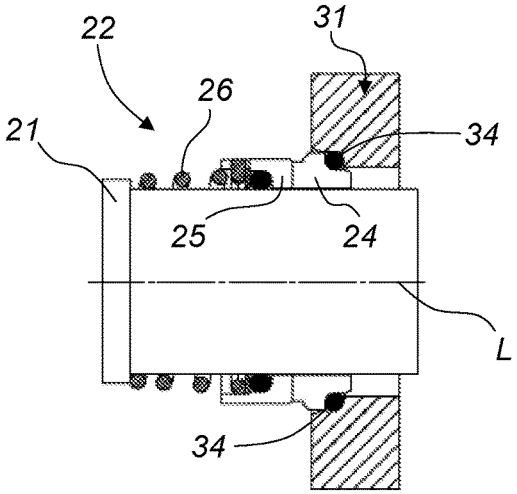
FIG. 23 is a partially broken-away lateral view of the detail of FIG. 22 as taken along an axial vertical plane.
Figure 24:
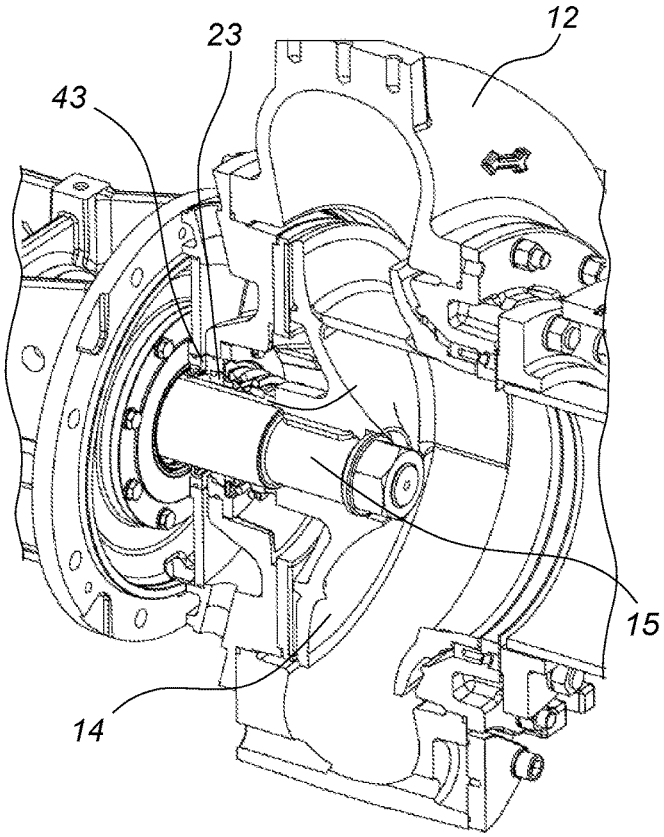
FIG. 24 is an axonometric view of an area of the pump contacted by the quench fluid.
Figure 25:
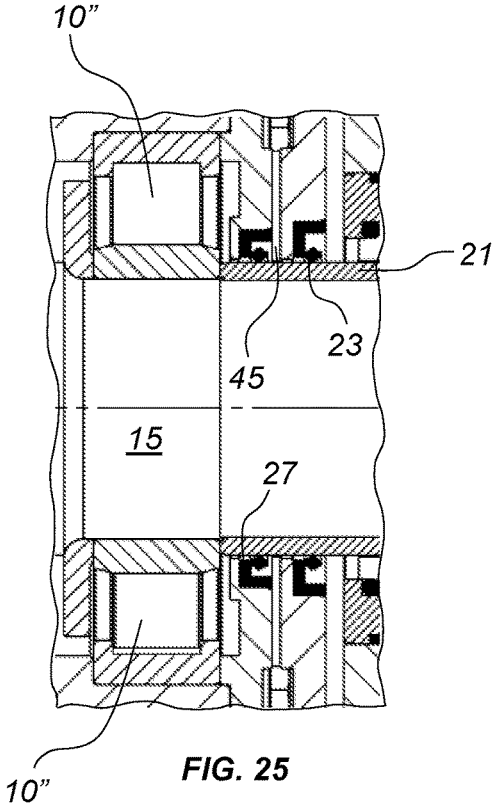
FIG. 25 is a partially broken-away lateral view of the area as shown in FIG. 24.

Conventionally, the mechanical seal 22, which is shown separately in FIGS. 22 and 23, comprises a stationary ring 24, a moving ring 25, coaxial and facing the stationary ring 24, rotating about the axis L and axially moving therealong, as well as elastic means 26, for example in the form of a coil spring, acting on the moving ring 25 to move its active lapped surface to wiping contact with the facing surface of the stationary ring 24.

Optionally, elastic bellows may be provided within the spring 26 to protect the mechanical seal 22.

In addition, a second lip seal 27 facing the first lip seal 23, and also having its peripheral edge in wiping contact with the outer cylindrical surface of the spacer 21, may be provided in a seat 18 of the upstream area 9.

Conveniently, a cavity 28 filled with a quench fluid is provided in the intermediate housing 11. The cavity 28 has a narrow passage 29 which is used to channel the quench liquid to the wiping-contact surfaces of the stationary ring 24 and the moving ring 25 of the mechanical seal 22. In particular, the passage 29 consists in spraying the wiping surfaces of the mechanical seal 22 when no liquid is present during the first startup stages when the pump 1 has not yet been primed and its pressure chamber 12 has not yet been filled with water.

In order to attach the mechanical seal 22 to the pump housing 2, the seal system 20 also includes a locking ring 30.

According to the invention, the locking ring 30 may be fastened to the pump housing 2, or rather to the intermediate housing 11, by means of removable fastening means 36 that can be removed and accessed through the suction port 13 of the pump 1 after removal of its front closing flange 16.

With this configuration, the impeller 14, the mechanical seal 22 and the lip seal 23 may be pulled off and replaced or serviced without disassembling the pump 1 and without accessing the bearings 10', 10" of the dry area 9.

More in detail, the locking ring 30 is essentially a toroidal body which may define therein an inner tubular portion 31 joined to a radial part 32 in coaxial arrangement, and with a first annular recess 33 formed therebetween.

Conveniently, the moving ring 25 is accommodated in the first annular recess 33 of the locking ring 30 facing the impeller 14.

The tubular portion 31 is locked in a first cylindrical seat 19 of the intermediate housing 11 with the interposition of a first O-ring.

In addition, a second cylindrical seat 34 is formed in the tubular section 31, in the locking ring 30, in which the stationary ring 24 is inserted and locked with the interposition of a second O-ring.

The radial part 32 is in turn accommodated in a compartment 35 of the intermediate housing 11 and is attached in that compartment 35 by multiple fastening means 36 of bolt type, preferably six in number.

With this configuration, the mechanical seal 22 and the lip seal 23 may be pulled out during servicing, after removing the impeller 14, without entirely disassembling the pump 1.

According to the invention, a anti-slip ring 37 is locked in the first annular recess 33 against the edge of the stationary ring 24 by means of a first elastic retaining ring 38 located in the compartment 35 of the intermediate housing 11.

The purpose of this anti-slip ring 37 is to prevent the displacement of the stationary ring 24 toward the impeller 14 under the high vacuum generated thereby.

Figure 6:
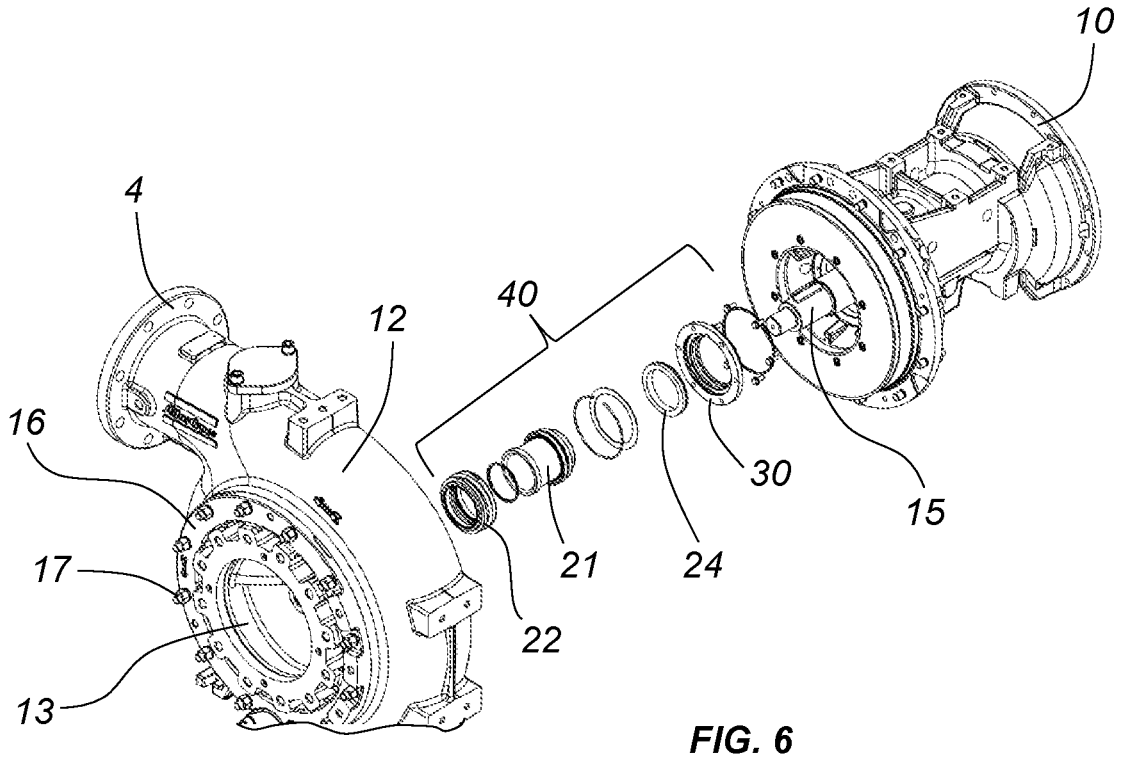
FIG. 6 is an exploded axonometric view of the sealing system of FIG. 4.
Figure 7:
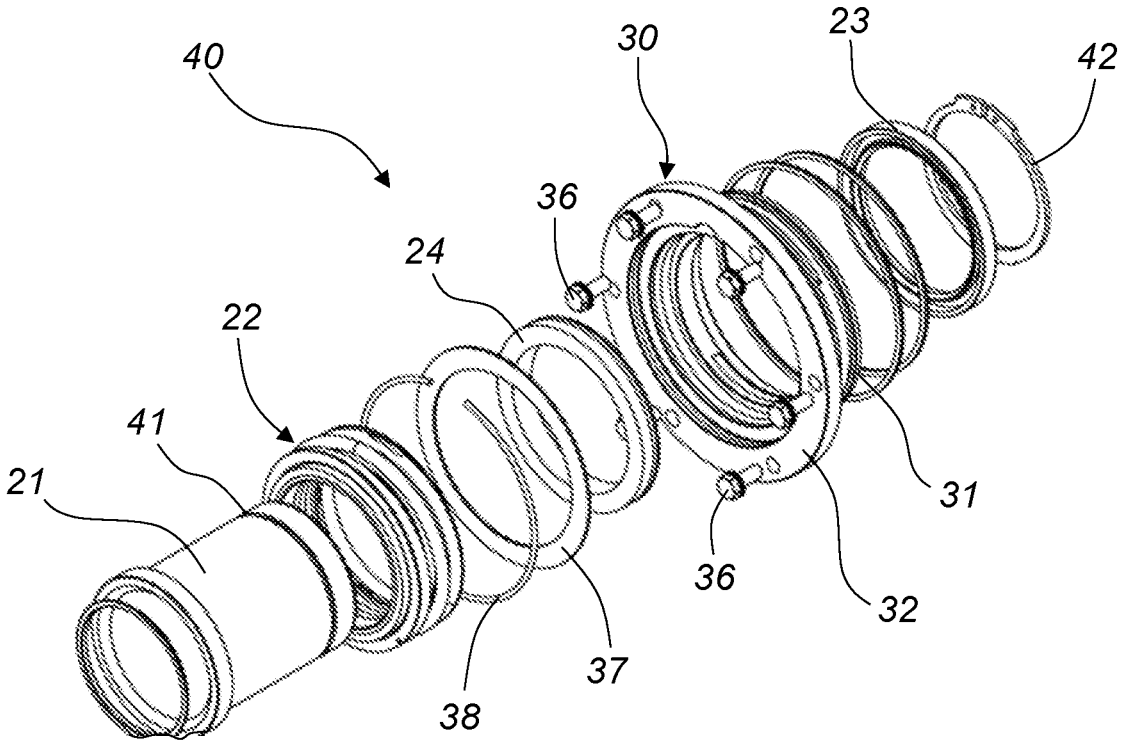
FIG. 7 is an enlarged exploded axonometric view of the sealing system of FIG. 5.

In a first embodiment of the invention, as clearly shown in the cross section of FIG. 4 and in the exploded views of FIGS. 6 and 7, the mechanical seal 22 and the lip seal 23 are both attached to the spacer 21 to define a so-called cartridge assembly, generally designated by numeral 40.

The cartridge assembly 40 can be removed as a whole from the shaft 15 when one or more of its components are removed and replaced.

For this purpose, the spacer 21 has an annular groove 41 proximate one axial end distal from the impeller 14 for a second elastic retaining ring or circlip 42 which axially locks the lip seal 23 in a second annular recess 43 of the locking ring 30 thereby defining the cartridge assembly 40.

The function and purpose of the second retaining ring or circlip 42 is to prevent disassembly of the cartridge system 40 when removing the locking ring 30 from the compartment 35 of the intermediate housing 11 and, on the other hand, to afford easy and proper positioning thereof back in place.

Figure 8:
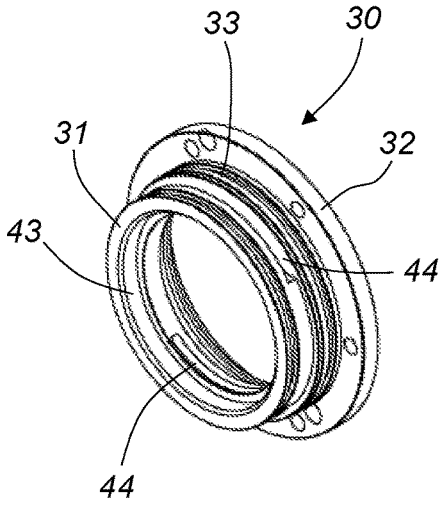
FIG. 8 is an axonometric view of a detail of the sealing system of FIGS. 4 and 5.
Figure 9:
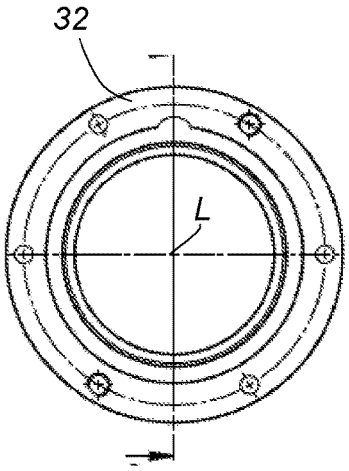
FIG. 9 is a front view of the detail of FIG. 8.
Figure 10:
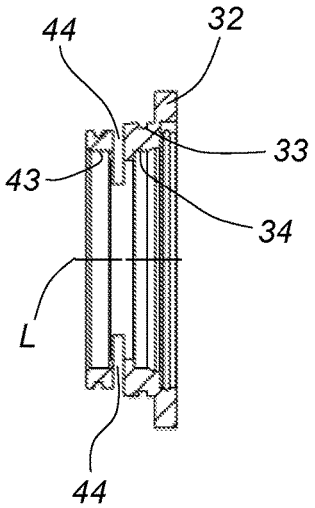
FIG. 10 is a lateral sectional view of the detail of FIG. 8.
Figure 11:
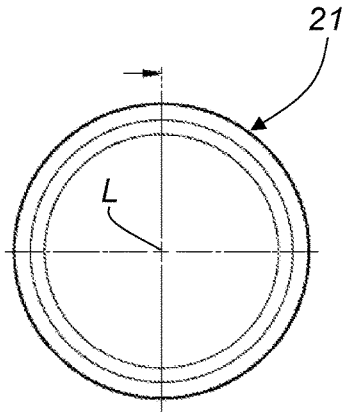
FIG. 11 is a front view of another detail of the sealing system of FIGS. 4 and 5.
Figure 12:
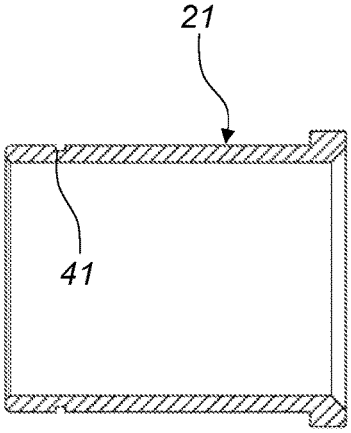
FIG. 12 is a lateral sectional view of the detail of FIG. 11.

In this embodiment, the locking ring 30, as best shown in FIGS. 8, 9 and 10, has an elongate inner tubular portion 31 having the second annular recess 43 and at least one pair of diametrically opposite through slots 44, substantially aligned with the passage 29 of the quench liquid to spray the dry wiping-contact surfaces of the mechanical seal 22, as clearly shown in FIGS. 8 and 10.

In particular, the locking ring 30 has a tubular portion 31 with a second annular recess 43 to accommodate and stably attach the lip seal 23 proximate an axial end of the tubular portion 31 distal from the locking ring 14.

Figure 15:
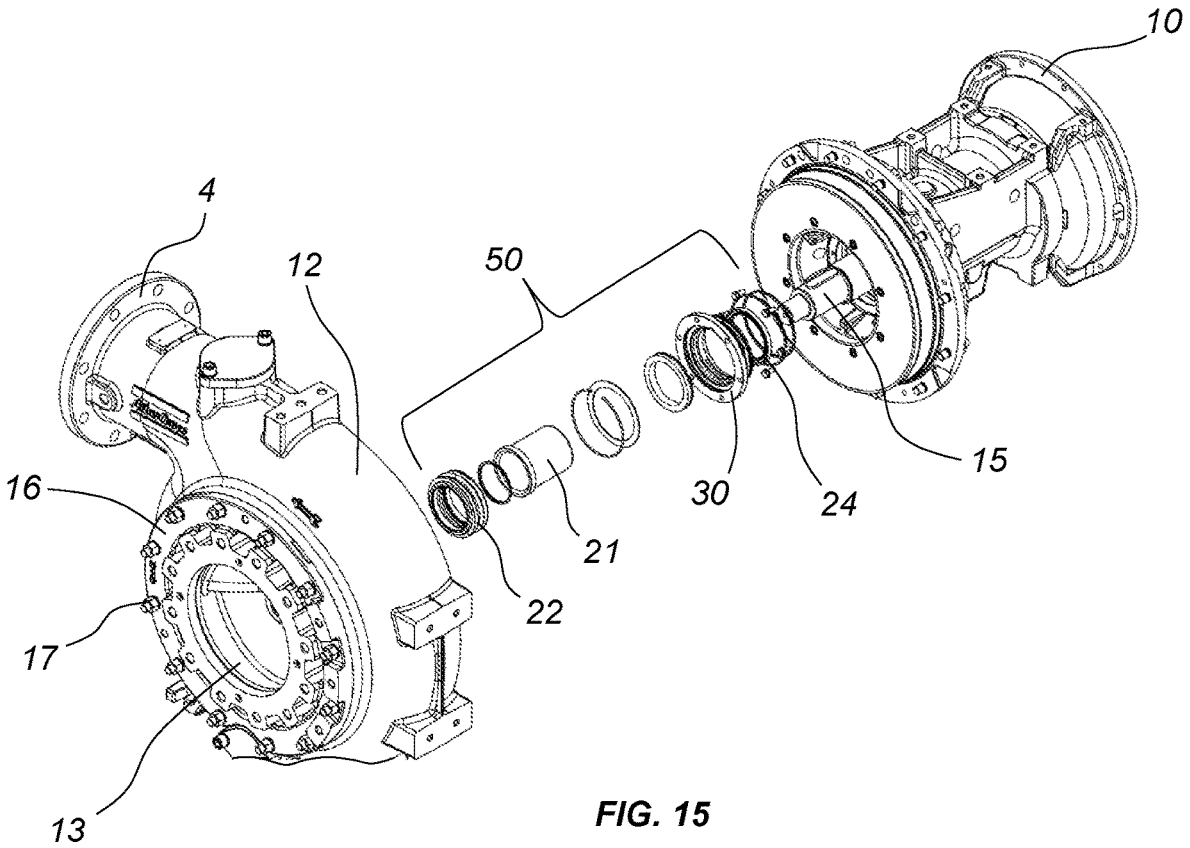
FIG. 15 is an exploded axonometric view of the sealing system of FIG. 13.
Figure 16:
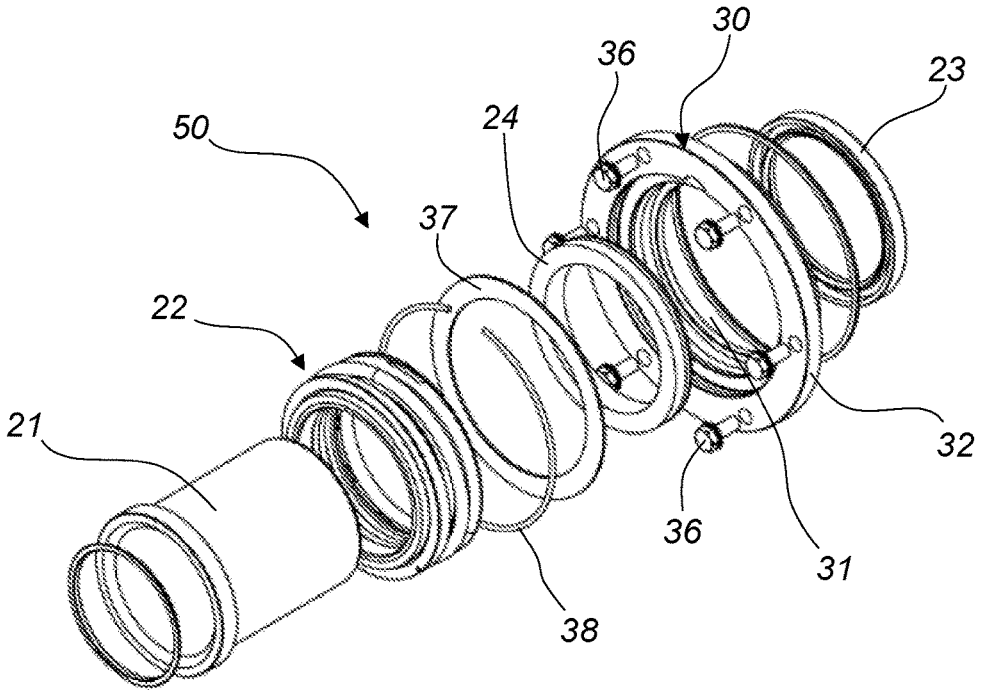
FIG. 16 is an enlarged exploded axonometric view of the sealing system of FIG. 15.

In a second embodiment of the invention, as clearly shown in the cross section of FIG. 14 and in the exploded views of FIGS. 15 and 16, only the mechanical seal 22 is attached to the spacer 21 to define a so-called half-cartridge assembly, generally designated by numeral 50.

Figure 17:
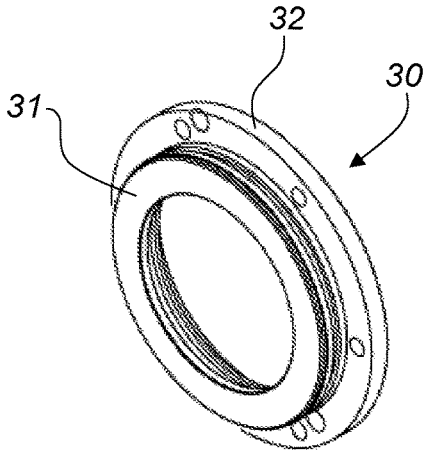
FIG. 17 is an axonometric view of a detail of the sealing system of FIGS. 13 and 14.
Figure 18:
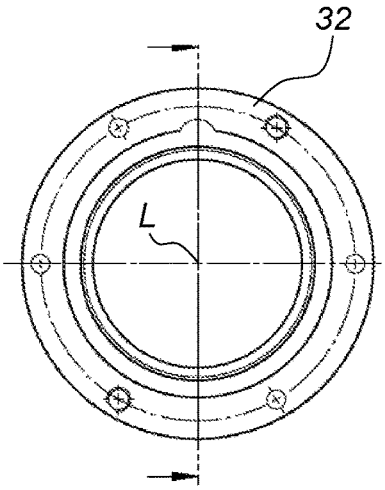
FIG. 18 is a front view of the detail of FIG. 17.
Figure 19:
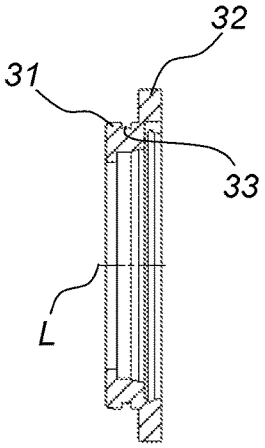
FIG. 19 is a lateral sectional view of the detail of FIG. 17.
Figure 20:
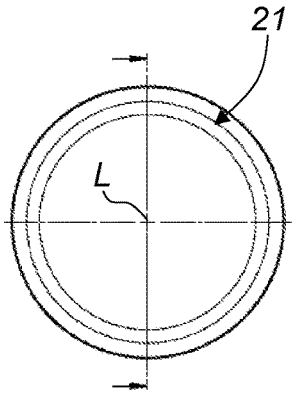
FIG. 20 is a front view of another detail of the sealing system of FIGS. 13 and 14.
Figure 21:
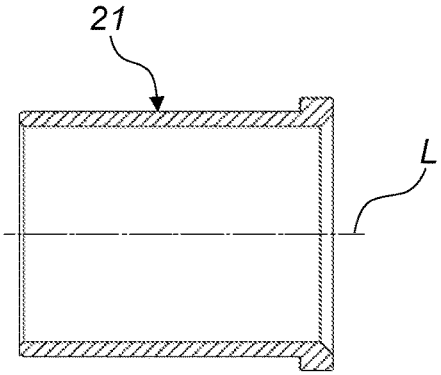
FIG. 21 is a lateral sectional view of the detail of FIG. 20.

In this second embodiment, the locking ring 30, as best shown in FIGS. 17, 18 and 19, has an inner tubular portion 31 that is shorter than that of the first embodiment as shown in FIGS. 8, 9 and 10.

Here, the half-cartridge assembly 50 can be slipped off the shaft 15 to remove the spacer 21 with the mechanical seal 22 and easily access the lip seal 23, which can be thus removed and replaced.

According to the invention, an annular outlet port 45 is provided downstream of the lip seal 23, and communicates with the atmosphere to drain the working liquid in the event of failure of the lip seal 23 and to prevent the liquid from reaching the dry area 9 of the pump housing 2 and damaging the bearings 10', 10" of the shaft 15.

In a further aspect, the invention provides a method of servicing a self-priming centrifugal pump assembly 1 with a multifunctional sealing system 20, which comprises at least the steps of:

a) providing a suction port 13 in the pressure chamber 12, whose inside diameter is larger than that of the impeller 14 and a front closing flange 16 whose inside diameter is smaller than that of the impeller 14;
b) disassembling the connecting joint 7 from the suction line;
c) removing the front closing flange 16;
d) axially pulling out the impeller 14 from the pressure chamber 12;
e) removing the screws 36 that fasten the locking ring 30;
f) removing the locking ring 30 from the compartment 35 of the intermediate housing 11 in combination with the cartridge assembly 40 with the lip seal 23 joined thereto; or
f') removing the locking ring 30 from compartment 35 of the intermediate housing 11 in combination with the half-cartridge assembly 50 and removing the lip seal 23;
g) replacing the lip seal 23 and possibly the mechanical seal 22 or some of its components;
h) repositioning the locking ring 30 with the cartridge 40 or half-cartridge assembly 50;
i) mounting the impeller 14 back to the shaft 15;
j) mounting the connecting joint 7 back to the suction line.

According to the invention, removal of the impeller 14 from the shaft 15 and the locking ring 30 from its seat of the intermediate housing 11, as well as repositioning thereof, are carried out through the suction port 13 after disassembly and removal of the front closing flange 16.

Advantageously, removal of the impeller 14 from the shaft 15 and the locking ring 30 from the compartment 35 of the intermediate housing 11, as well as repositioning thereof, are carried out through the suction port 13 after disassembly and removal of the front closing flange 16 without completely disassembling the pump 1.

According to a peculiar aspect of the method, the steps f) or f)' are carried out without removing the bearings 10', 10" from the dry area 9 of the pump housing 2.

This avoids exposure of the bearings 10', 10" when servicing the pump 1, thus reducing the risk of damage to the bearings 10', 10".

Of course, no intermediate steps have been described involving removal and mounting back O-rings in areas that require hydraulic blocking or sealing.

In general, this method avoids full disassembly of the pump and its accessories, thereby considerably facilitating servicing and replacement of gaskets and/or mechanical seals, which may also be carried out by non-specially skilled personnel and directly in the areas of use, e.g. on site.

In light of the foregoing, the self-priming centrifugal pump assembly with the multifunctional sealing system of the invention fulfills its intended purposes, and is namely configured to facilitate servicing of the mechanical seal and the lip seal in both cases of cartridge- and half-cartridge assembly, while reducing the risk of damage to the bearings.

The self-priming centrifugal pump assembly with the multifunctional sealing structure of the invention is susceptible of a number of changes and variants, within the inventive concept as disclosed in the appended claims. All the details thereof may be replaced by other technically equivalent parts, and the materials may vary depending on different needs, without departure from the scope of the invention.

While the assembly has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in factories for manufacturing pumps and centrifugal operating machines.

The invention claimed is:

1. A self-priming centrifugal pump assembly (1) with a multifunctional sealing system (20), wherein the pump (1) comprises:

a housing (2) having a downstream wet area (8) contacted by a working fluid and an upstream dry area (9) not contacted by the working fluid and equipped with bearings (10', 10") for supporting a drive shaft (15), a volute pressure chamber (12) located in said downstream area (8) to accommodate a vane impeller (14) which is designed to be keyed to said shaft (15), wherein the sealing system (20) comprises:

a tubular spacer (21) mounted to the shaft (15) and configured to be attached thereto proximate to the vane impeller (14);

a mechanical seal (22) mounted to said tubular spacer (21);

a first lip seal (23);

a locking ring (30) for attaching said mechanical seal (22) to said housing (2), and wherein said pressure chamber (12) has a suction port (13) with an inner diameter larger than an inner diameter of the impeller (14) and a front closing flange (16) with an inner diameter smaller than the inner diameter of the impeller (14), said locking ring (30) being designed to be fastened to said housing (2) by removable fastening means (36) that can be accessed through the suction port (13) of the pump (1) after removal of the front closing flange (16), so that the impeller (14), said mechanical seal (22), and said lip seal (23) can be removed and replaced or serviced without disassembling the pump (1) and without accessing the bearings (10', 10") of said upstream dry area (9), wherein said locking ring (30) has a radial portion (32) configured to be accommodated in a compartment (35) of an intermediate housing (11) of the pump housing (2), a plurality of holes being provided receive bolts defining said removable fastening means (36), wherein said mechanical seal (22) and said first lip seal (23) are both attached to said tubular spacer (21) to define a unitary cartridge assembly (40), which is integrally removable from the shaft (15) when one or more components of the unitary cartridge assembly are being disassembled and replaced, and wherein said locking ring (30) has a tubular portion (31) with a second annular recess (43) to accommodate and stably attach said first lip seal (23) proximate to an axial end of said tubular portion (31) distal from the locking ring (14).

2. The self-priming centrifugal pump assembly as claimed in claim 1, wherein at least one outlet port (45) is provided downstream of the first lip seal (23) to drain the working fluid in an event of a failure of the first lip seal and to prevent the working fluid from reaching the dry area (9) of the pump (1), thereby damaging said bearings (10', 10").

3. The self-priming centrifugal pump assembly as claimed in claim 1, wherein said mechanical seal (22) comprises a stationary ring (24), a movable ring (25) facing said stationary ring (24), elastic means (26) acting on said moving ring (25) to bias said moving ring to sliding engage said stationary ring (24).

4. The self-priming centrifugal pump assembly as claimed in claim 3, wherein said stationary ring (24) is accommodated in a cylindrical seat (34) formed in said locking ring (30).

5. The self-priming centrifugal pump assembly as claimed in claim 3, wherein said movable ring (25) is accommodated in a first annular recess (33) of said locking ring (30) facing the impeller (14).

6. The self-priming centrifugal pump assembly as claimed in claim 5, further comprising an anti-slip ring (37) locked in said first annular recess (33) and contacting said stationary ring (24) to prevent a displacement thereof toward the impeller (14) when a high vacuum condition is generated thereby.

7. The self-priming centrifugal pump assembly as claimed in claim 6, wherein said anti-slip ring (37) is locked in said first annular recess (33) with a first elastic retaining ring (38).

8. The self-priming centrifugal pump assembly as claimed in claim 1, wherein said tubular spacer (21) has an annular groove (41) proximate to an axial end thereof distal from the impeller (14) for a second elastic retaining ring or circlip (42) which axially locks said first lip seal (23) in said second annular recess (43) to define said unitary cartridge assembly (40).

9. The self-priming centrifugal pump assembly as claimed in claim 1, further comprising a passage (29) for a quench fluid to be sprayed on wiping surfaces of said mechanical seal (22) when no working fluid is present.

10. The self-priming centrifugal pump assembly as claimed in claim 9, wherein the tubular portion (31) of said locking ring (30) has at least one pair of diametrically opposite through slots (44), aligned with said passage (29) for the quench fluid.

11. The self-priming centrifugal pump assembly as claimed in claim 1, wherein only said mechanical seal (22) is attached to said tubular spacer (21) to define a half-cartridge assembly (50), which is removable from the shaft (15) to remove said mechanical seal (22) and access said first lip seal (23).

12. A method of servicing a self-priming centrifugal pump assembly (1) with a multifunctional sealing system (20) as claimed in claim 1, the method comprising:

providing the self-priming centrifugal pump assembly (1) with a multifunctional sealing system (20) as claimed in claim 1;

providing in the pressure chamber (12) the suction port (13) having the inner diameter larger than the inner diameter of the impeller (14) and the front closing flange (16) having the inner diameter smaller than the inner diameter of the impeller (14);

disassembling a connecting joint (7) from a suction line;

removing the front closing flange (16);

axially pulling out the impeller (14) from the pressure chamber (12);

removing the fastening means (36) that fasten the locking ring (30);

removing the locking ring (30) from the compartment (35) of the intermediate housing (11) in combination with the cartridge assembly (40) with the lip seal (23) joined thereto; or f')

wherein a removal of the impeller (14) from the shaft (15) and the locking ring (30) from the compartment (35) of the intermediate housing (11), and the repositioning of the locking ring, are carried out through the suction port (13) after disassembly and removal of the front closing flange (16) without completely disassembling the pump (1); and wherein the step of removing the locking ring is carried out without removing the bearings (10', 10") from the dry area (9) of the housing (2).

* * * * *